US005147056A

United States Patent [19]

Ma

[11] Patent Number: 5,147,056

[45] Date of Patent: Sep. 15, 1992

[54] FOOT ACTUATED OPENER FOR TRASH BIN

[76] Inventor: Mark Ma, 1415 Martens Dr., Hammond, La. 70401

[21] Appl. No.: 466,000

[22] Filed: Jan. 16, 1990

[51] Int. Cl.[5] ..... B65O 43/26

[52] U.S. Cl. ..... 220/263; 220/661; 220/908; 232/43.1; 232/43.2

[58] Field of Search ..... 220/262, 263, 264, 334, 220/661, 908; 232/43.1, 43.2, 43.5

[56] References Cited

U.S. PATENT DOCUMENTS

| | | | |
|---|---|---|---|
| 816,886 | 4/1906 | Shonnard | 220/263 X |
| 2,071,486 | 2/1937 | Wright | 220/263 |
| 2,456,840 | 12/1948 | Rogers et al. | 220/263 |
| 2,533,524 | 12/1950 | Snider | 220/263 X |
| 3,249,294 | 5/1966 | Hughes et al. | 232/43.2 |
| 3,799,430 | 3/1974 | Huguenin | 232/43.2 |
| 4,609,122 | 9/1986 | Ziegenbein | 220/211 |
| 4,729,490 | 3/1988 | Ziegenbein | 220/211 |
| 4,907,715 | 3/1990 | Bloomer | 220/263 |
| 5,011,026 | 4/1991 | Hausman et al. | 232/43.2 X |

*Primary Examiner*—Stephen Marcus
*Assistant Examiner*—Stephen Cronin
*Attorney, Agent, or Firm*—Pravel, Gambrell, Hewitt, Kimball & Krieger

[57] ABSTRACT

An apparatus adaptable to a trash bin, the bin being of the type having four side walls, and a swinging door panel on the upper portion of one of the side walls, for allowing the panel to be manually opened and a tray to be slid within the opening and food or trash allowed to be dumped from the tray into a trash can contained within the bin. The apparatus would comprise a foot pedal hingedly secured to the interior wall of the bin, and an opening above the foot pedal so that one may have access to the foot pedal with one's foot, a line running from the front face of the foot pedal upward and interconnecting the interior face of the door panel; and a pulley secured to the side wall of the bin, so that the line runs over the pulley, in such a fashion when one places force downward on the foot pedal, the line is retracted so that the door panel is swung into the opening within the container, thus giving access to the container through the opening formed by the opened panel. Upon removal of one's foot from the pedal, the door would simply be returned back to the closed position for sealing off the opening in the container.

7 Claims, 1 Drawing Sheet

FOOT ACTUATED OPENER FOR TRASH BIN

BACKGROUND OF THE INVENTION

1. Field of the Invention

The apparatus of the present invention relates to the trash bins. More particularly, the present invention relates to an apparatus adaptable to a trash bin, for actuating the door of the bin by a foot pedal therefore eliminating the use of hands.

2. General Background

In many trash bins, particularly of the type that are found in fast-food outlets, the trash bin is for the most part a rectangular shaped four-sided receptacle, wherein one of the sides includes a swinging door so that one may push the tray into the door and allow the trash to fall within a container contained within the bin. The shortcomings of this particular item is the fact that the swinging door often times must be pushed by one hand, so that the tray may be maneuvered into the space with the other hand and the tray emptied. Often times this is an inconvenience due to the fact that the door may have been soiled by food spillage onto the face of the door. Another problem concerned is the fact that often times a child does not have the strength to support the tray in one hand, while attempting to open the door with the second hand and sliding the tray containing the trash into the passageway after the door has been opened. Therefore, there is a need to provide a means for allowing the swinging door of the bin to swing open to be actuated by other than one's hands so that the door may swing open and the tray may be easily maneuvered into the doorway using both hands if one chooses to.

SUMMARY OF THE PRESENT INVENTION

The apparatus of the present invention solves the problems in the art in a simple and straightforward manner. What is provided is an apparatus adaptable to an existing trash bin, the bin being of the type having four side walls, and a swinging door panel on the upper portion of one of the side walls, for allowing the panel to be manually opened and a tray to be slid within the opening and food or trash allowed to be dumped from the tray into a container housed within the bin. The apparatus would comprise a foot pedal hingedly attached to the lower wall of the bin, a line extending from the front face of the foot pedal upward and interconnecting the interior face of the door panel; and a pulley secured to the side wall of the bin, so that the line runs over the pulley, in such a fashion when one places force downward on the foot pedal, the line is retracted so that the door panel is swung into the opening within the container, thus giving access to the container through the opening formed by the opened panel. Upon removal of one's foot from the pedal, the door would simply be returned back to the closed position for sealing off the opening in the container.

Therefore, it is a principal object of the present invention to provide a foot actuated means for opening a hinged panel door on a trash container, so as to allow access into the container without the use of one's hands.

It is a further object of the present invention to provide a foot-actuated opener for a swinging door of a food deposit bin, that is adaptable to an existing bin, particularly of the type food in fast food outlets.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
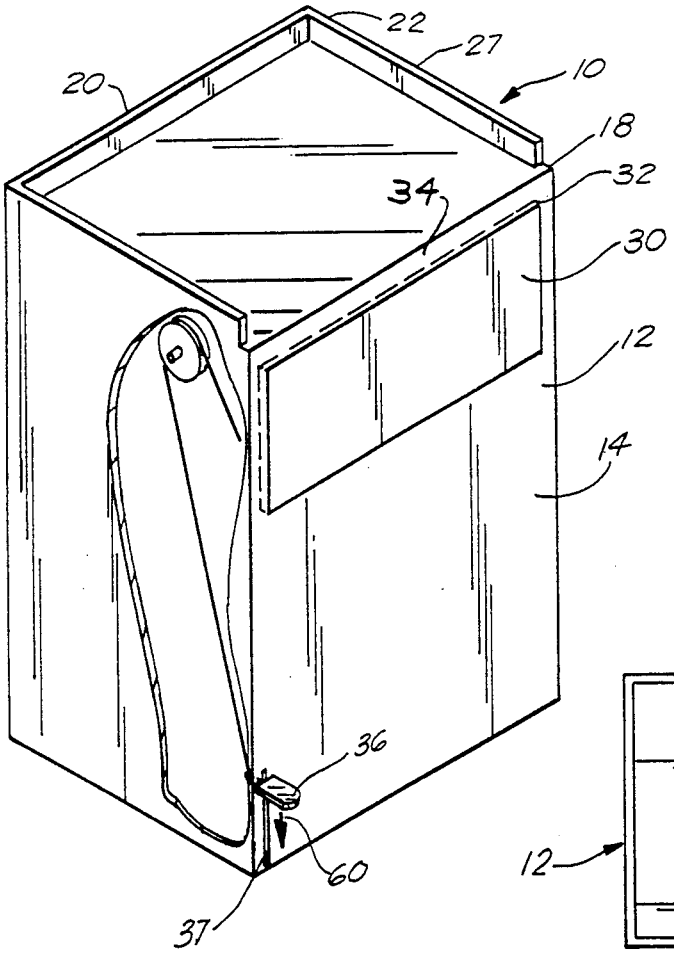
FIG. 1 is an overall partial cut-away view of the preferred embodiment of the apparatus of the present invention.
Figure 2:
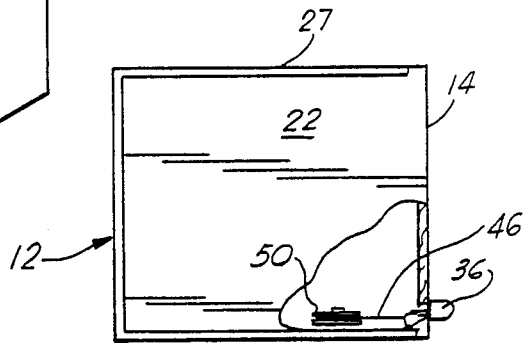
FIG. 2 illustrates a top view of the preferred embodiment of the apparatus of the present invention.

The preferred embodiment of the apparatus of the present invention is illustrated in the Figures by the numeral 10. As illustrated, apparatus 10 could be defined as a four sided container 12 having a front side 14, a pair of side walls 16 and 18, and a rear wall 20, each of the four sides forming a substantially rectangular container having a top wall 22. For the most part, the container would have no bottom, and would simply house a typical trash bin 24 (as seen in phantom view in FIGS. 3 and 4), within the opening 25 formed by the four side walls. This type of container, would be of the type that is found in many fast food outlets, and is utilized to allow patrons who have finished eating, to deposit their refuse within the trash can 24 housed within container 12 after use. Since the food is carried normally on a tray 26, the container would be so constructed so as to allow all empty trays 26 to be stacked upon top portion 22, which is partially surrounded by a barrier 27 as illustrated in FIG. 1.

Further, this type of a container would normally include a hinged door portion 30, as illustrated in FIG. 1, which would be hinged along its top edge 32 to the top portion 34 of forward wall 14, and would normally hang free in the closed position as seen in FIG. 1. When one would wish to deposit trash within the container, one would simply force a tray against door 30, and door 30 would swing inwardly so that the refuse in the tray 26 may be deposited within container 24. Upon retrieval of the tray 26 from the container, the door 30 would return to its closed position as seen in FIG. 1.

Figure 4:
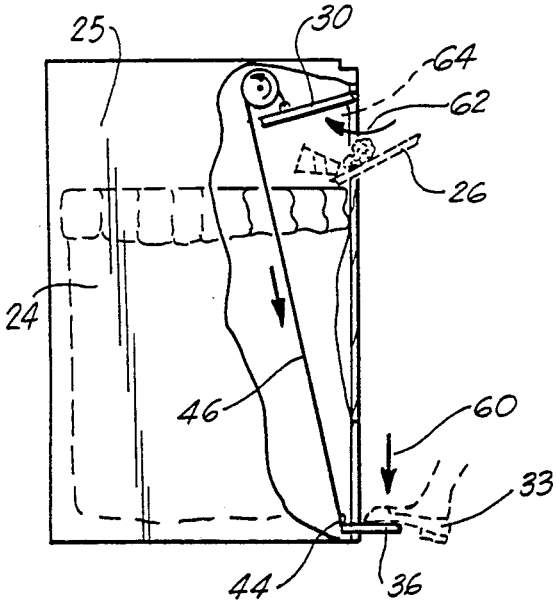
FIGS. 3 and 4 illustrate side partial views of the apparatus of the present invention during the actuating of the door panel.

Turning now to the present invention, reference is made to FIGS. 1 through 4, wherein there is illustrated the present invention adapted to this standard type of container 12. This adaptation would include a foot pedal 36 which has been adapted to the front wall 14 of container 12, foot pedal 36 being of the type that is movable between a first upper position as seen in FIG. 1, to a second down position as seen in FIG. 4. Foot pedal 36 would be engaged into a slot 37 cut into the front wall 14 of container 12, and would track upward and downward along a track 39 as seen in phantom view in FIG. 3.

Figure 3:
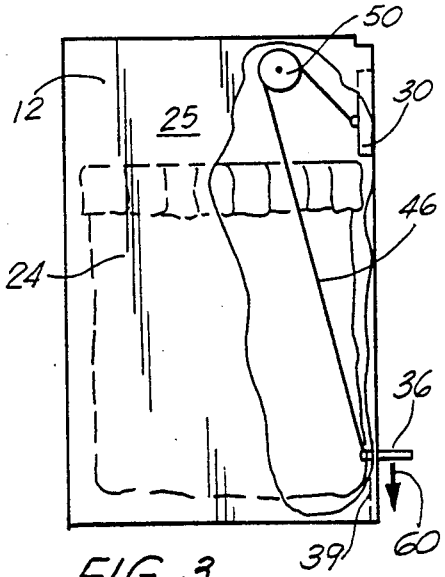

Foot pedal 36 would be adapted with a means 44 for attaching a flexible line 46 into the forward edge 48 of foot pedal 36, and extending the line 46 upward to run around a pulley 50, with pulley 50 mounted onto the side walls 16 of container 12, via an axle 52, so that pulley 50 is freely rotatable on axle 52. After running around pulley 50, line 46 would extend and attach to an attachment means 54 on the inner face 56 of door 30, as illustrated in FIGS. 1 and 3. As clearly illustrated, the line 46 would be drawn taut when the door is in the closed position as seen in FIG. 3, and the foot pedal 36 is in the up position, as seen in FIG. 3.

In order to utilize the present invention, one would place one's foot 33 onto foot pedal 36 and force the foot pedal downward in the direction of Arrow 60, as illustrated in FIG. 4 defining an opening 64 it once occupied. This of course would impart downward movement to line 46, which would then force door 30 into the open position as seen in FIG. 4, with door 30 naturally swinging inwardly in the direction of Arrow 62 as seen in FIG. 4. Since the opening of door 30 has been actuated by the action of the foot pedal, one would be free to move tray 26 into the opening 64 as defined by the movement of door 30, and deposit any refuse into container 24. Tray 26 would then be removed from opening 64, and one would release the foot pedal 36 by removing one's foot from the pedal, and the door would turn into the closed position as illustrated in FIGS. 1 and 3.

Therefore, with the use of this particular adaptation to the container, one would have the ability to move a tray into the opening with both hands, and with the door 30 being swung into the opened position, via the action of one's foot onto the foot pedal 36 as illustrated.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An apparatus for opening a door of a container, without the use of one's hands, the apparatus comprising:

a) a four wall container, with at least one wall having a hinged door along its upper portion, normally in a closed position forming a portion of the wall;

b) a foot pedal, positioned substantially along the lower portion of the wall, the foot pedal protruding outward from a slot in the front wall of the four wall structure, and movable between a first up position to a second down position when a person's foot forces the foot pedal to the down position;

c) a line extending between the foot pedal and the hinged door, so that upon downward movement of the foot pedal, the line would pull the hinged door from the closed position, to a position so that the door allows access into the container while the foot pedal is in the down position; and means intermediate the foot pedal and the door for allowing upward swinging of the door when the foot pedal is moved downward.

2. The apparatus in claim 1, wherein the foot pedal, the line extending from the foot pedal, and the means intermediate the foot pedal and the door are adaptable to an existing container apparatus having a hinged door.

3. The apparatus in claim 1, wherein the means intermediate the foot pedal and the door for allowing upward swinging of the door when the foot pedal is moved downward comprises a pulley wheel mounted to the sidewall of the container.

4. The apparatus in claim 1, wherein the foot pedal is engaged along a track member mounted to the interior wall of the apparatus so that the foot pedal may move between the first up position and a second down position when pressure is placed on the upper surface of the foot pedal.

5. The apparatus in claim 1, wherein when the foot is removed from the foot pedal, the door is allowed to swing to the normally closed position returning the foot pedal to the upward position.

6. An apparatus adaptable to a container of the type having four walls, a hinged door on the upper portion of at least one of the walls, a trash bin contained within the container, the apparatus comprising:

a) a foot pedal, at least a portion of which extends outward from the forward wall of the container, and a second portion which is mounted to a track within the container, the foot pedal movable from a first up position to a second down position by pressure of a person's foot;

b) a line extending from that portion of the foot pedal which is housed in the interior of the container to the rear wall of the door;

c) a pulley wheel which is rotatably mounted along the upper portion of the container, with the line extending over the pulley wheel to the rear portion of the door; and d) means for allowing the foot pedal to be moved into the down position, whereupon the line is drawn taut and in turn moves the door from a normally closed position to an open position wherein the door is swung inwardly into the container so that access may be had into the container for the dumping of trash.

7. The apparatus in claim 6, wherein upon release of the foot pedal by one's foot, the door returns to the normally closed position, and the foot pedal is returned to the up position.

* * * * *